US009131577B2

(12) United States Patent
Oshima et al.

(10) Patent No.: US 9,131,577 B2
(45) Date of Patent: Sep. 8, 2015

(54) LIGHT EMITTING ELEMENT DRIVE DEVICE

(71) Applicant: TDK Corporation, Tokyo (JP)

(72) Inventors: Kazunori Oshima, Tokyo (JP); Hironobu Masuoka, Tokyo (JP); Yukiharu Miyaoka, Tokyo (JP); Mitsuyuki Tsujisaka, Chuo-ku (JP)

(73) Assignee: TDK Corporation (JP)

( * ) Notice: Subject to any disclaimer, the term of this patent is extended or adjusted under 35 U.S.C. 154(b) by 329 days.

(21) Appl. No.: 13/744,767

(22) Filed: Jan. 18, 2013

(65) Prior Publication Data

US 2013/0187570 A1 Jul. 25, 2013

(30) Foreign Application Priority Data

Jan. 19, 2012 (JP) ..... 2012-009052

(51) Int. Cl.
*H05B 33/08* (2006.01)

(52) U.S. Cl.
CPC ..... *H05B 33/0848* (2013.01)

(58) Field of Classification Search
USPC ..... 315/185 R, 193, 224, 295–297, 315/307–308, DIG. 4; 362/545, 555, 612
See application file for complete search history.

(56) References Cited

U.S. PATENT DOCUMENTS

| | | | | |
|---|---|---|---|---|
| 8,400,079 | B2 * | 3/2013 | Kanamori et al. | 315/307 |
| 8,669,934 | B2 * | 3/2014 | Sasaki | 345/102 |
| 2009/0237007 | A1 * | 9/2009 | Leng | 315/297 |
| 2011/0157246 | A1 * | 6/2011 | Jang | 345/690 |

FOREIGN PATENT DOCUMENTS

| | | | |
|---|---|---|---|
| JP | 2002-034264 | A | 1/2002 |
| JP | 2005-142137 | | 6/2005 |
| JP | 2010-062184 | A | 3/2010 |
| JP | 2010-207058 | A | 9/2010 |
| JP | 2011-249145 | A | 12/2011 |

OTHER PUBLICATIONS

Japanese Office Action for Application No. 2012-009052 dated Nov. 29, 2013 (2 pages).
Japanese Office Action for Application No. 2012-009052 dated Jul. 8, 2914 with English translation (4 pages).

* cited by examiner

*Primary Examiner* — An Luu
(74) *Attorney, Agent, or Firm* — Harness, Dickey & Pierce, P.L.C.

(57) ABSTRACT

A light emitting element drive device with PWM dimming includes an LED module, a power conversion circuit that supplies electric power to the LED module, a dimming switch element that performs an open/close operation for a path in which a current flows in the LED module, and a voltage detection circuit that detects a voltage value of a voltage that is output from the power conversion circuit. When the dimming switch element is turned ON, a control circuit performs feedback control so as to make a current value of the current close to a first target value. When the dimming switch element is turned OFF, the control circuit performs feedback control so as to make the voltage value close to a second target value. Wherein, the first target value is a predetermined value and the second target value is set based on the voltage value.

10 Claims, 3 Drawing Sheets

LIGHT EMITTING ELEMENT DRIVE DEVICE

CROSS-REFERENCE TO RELATED APPLICATION

This application claims priority to Japanese Patent Application No. 2012-009052 filed Jan. 19, 2012 which is hereby expressly incorporated by reference herein in its entirety.

BACKGROUND

The present invention relates to a light emitting element drive device that drives a light emitting element, such as a light emitting diode (LED). Specifically, the light emitting element drive device performs pulse width modulation (PWM) dimming.

Japanese Patent Publication No. 2005-142137 discloses an LED lighting device. In the disclosed LED lighting device, a current flowing in an LED module is detected. The LED module is configured with a plurality of LEDs that are connected in series. Then, an operation of a direct current (DC) voltage conversion circuit is controlled so as to make the detected current a constant value (a target current value). In the circuit shown in FIG. 13 of Japanese Patent Publication No. 2005-142137, dimming of the LED module is performed by changing an ON-OFF ratio of a dimming switch element that is connected to the LED module in series. In the disclosed circuit, because a current flows in the LED module only in the case in which the dimming switch element is turned ON, the above control, i.e., the current flowing in the LED module becomes the target current value, is performed only when the dimming switch element is turned ON.

However, the above conventional technology has the following problems. Even though the above control (the current flowing in the LED module becomes the target current value) is performed immediately after the dimming switch element, which is connected to the LED module in series, is turned ON, it takes a certain period of time until the current actually reaches the target current value. Therefore, before the current reaches the target current value, a stable light output cannot be obtained.

SUMMARY

An object of the present invention is to provide a light emitting element drive device with PWM dimming in which a period of time required to reach a target current value for a current flowing in a light emitting element is shortened.

A light emitting element drive device according to one aspect of the present invention includes: a light emitting element; a power conversion circuit that supplies electric power to the light emitting element; a dimming switch element that performs an open and close operation for a path in which a current flows in the light emitting element; a current detection circuit that detects a current value of the current flowing in the light emitting element; a voltage detection circuit that detects a voltage value of a voltage that is output from the power conversion circuit; and a control circuit that performs feedback control. When the dimming switch element is turned ON, the control circuit performs the feedback control so as to make the current value close to a first target value. The first target value is a predetermined value. When the dimming switch element is turned OFF, the control circuit performs the feedback control so as to make the voltage value close to a second target value. The second target value is set based on the voltage value. Specifically, the second target value may be set based on the voltage value that is detected by the voltage detection circuit while the dimming switch element is turned ON.

In the light emitting element drive device according to the above aspect, constant current control for the light emitting element is performed so as to make the current value of the current flowing in the light emitting element close to the predetermined first target value while the dimming switch element is turned ON. In contrast, control is performed so as to make the voltage value output from the power conversion circuit close to the second target value while the dimming switch element is turned OFF. Because the second target value is set based on the voltage value detected by the voltage detection circuit while the dimming switch element is turned ON, an output voltage from the power conversion circuit while the dimming switch element is turned OFF depends on an output voltage from the power conversion circuit while the dimming switch element is turned ON. Therefore, when the dimming switch is turned ON, the current value detected by the current detection circuit can reach the predetermined first target value as fast as possible. As a result, in the light emitting element drive device with the PWM dimming, a period of time required to reach a target current value for the current flowing in the light emitting element is shortened.

Further in the light emitting element drive device according to the above aspect, the second target value is set based on the voltage value that is detected by the voltage detection circuit when the current value is substantially the same as the first target value.

As discussed above, it is preferred that while the dimming switch element is turned ON, specifically under a condition in which the current value detected by the current detection circuit is substantially the same as the first target value, the second target value is set based on the voltage value that is detected by the voltage detection circuit. Therefore, an output voltage from the power conversion circuit while the dimming switch element is turned OFF is maintained at the same voltage as an output voltage from the power conversion circuit while the dimming switch element is turned ON. As a result, when the dimming switch element is turned ON, the current value detected by the current detection circuit can immediately reach the first target value. Therefore, a period of time required to reach the first target value for the current flowing in the light emitting element is certainly shortened.

Instead of performing the above features, the second target value may be set based on the voltage value that is detected by the voltage detection circuit immediately before the light emitting element is turned OFF.

As discussed above, it is preferred that in the case in which the second target value is set based on the voltage value that is detected by the voltage detection circuit immediately before the light emitting element is turned OFF, even though it is not determined whether the current value detected by the current detection circuit is substantially the same as the first target value while the dimming switch element is turned ON, the following can be realized. An output voltage from the power conversion circuit while the dimming switch element is turned OFF is maintained at the same voltage as an output voltage from the power conversion circuit while the dimming switch element is turned ON. As a result, when the dimming switch element is turned ON, the current value detected by the current detection circuit can immediately reach the first target value. Therefore, a period of time required to reach the first target value for the current flowing in the light emitting element is certainly shortened.

A light emitting element drive device according to another aspect of the present invention includes: a light emitting element; a power conversion circuit that supplies electric power to the light emitting element; a dimming switch element that performs an open/close operation for a path in which a current flows in the light emitting element; a first voltage detection circuit that detects a first voltage value of a first voltage of an input terminal of the dimming switch element; a second voltage detection circuit that detects a second voltage value of a second voltage that is output from the power conversion circuit; and a control circuit that performs feedback control. When the dimming switch element is turned ON, the control circuit performs feedback control so as to make the first voltage value close to a first target value. The first target value is a predetermined value. When the dimming switch element is turned OFF, the control circuit performs feedback control so as to make the second voltage value close to a second target value. The second target value is set based on the second voltage value. Specifically, the second target value is set based on the second voltage value that is detected by the second voltage detection circuit while the dimming switch element is turned ON.

In the light emitting element drive device according to the above aspect, control for the light emitting element is performed so as to make the first voltage value of the first voltage of the input terminal of the dimming switch element close to the predetermined first target value while the dimming switch element is turned ON. In contrast, control is performed so as to make the second voltage value output from the power conversion circuit close to the second target value while the dimming switch element is turned OFF. Because the second target value is set based on the second voltage value detected by the second voltage detection circuit while the dimming switch element is turned ON, an output voltage from the power conversion circuit while the dimming switch element is turned OFF depends on an output voltage from the power conversion circuit while the dimming switch element is turned ON. Therefore, when the dimming switch is turned ON, the first voltage value of the first voltage of the input terminal of the dimming switch element can reach the predetermined first target value as fast as possible. As a result, in the light emitting element drive device with the PWM dimming, a period of time required to reach the target current value for the current flowing in the light emitting element is shortened.

As discussed above, it is preferred that the light emitting element drive device further includes a resistor that is connected to an output terminal of the dimming switch element and an adjustment circuit that adjusts a third voltage applied to a control terminal of the dimming switch element so as to make a third voltage value of the third voltage close to a third target value.

As mentioned above, a voltage value, which corresponds to a current value of a current flowing in the light emitting element, of an output terminal of the dimming switch element can be close to the third target value by only adding the adjustment circuit. This control is independent from the feedback control by the control circuit.

Further, in the light emitting element drive device according to the above aspect, the control circuit further includes: a conversion circuit that performs a conversion operation in which the voltage value, which is detected by either of the voltage detection circuit or the second voltage detection circuit, is converted to a digital value; and a retaining circuit that retains the digital value output from the conversion circuit as a retained digital value. The conversion circuit repeats the conversion operation in a predetermined cycle so that a new digital value is output after a previous digital value is output. When the conversion circuit outputs the new digital value while the dimming switch element is turned ON, the retaining circuit exchanges the previous digital value with the new digital value. When the conversion circuit outputs the new digital value while the dimming switch element is turned OFF, the retaining circuit retains the previous digital value. It is preferred that the control circuit determines that the retained digital value is used as the second target value.

As discussed above, it is preferred that the detected current value or the voltage value of the input terminal of the dimming switch element can reach the predetermined first target value when the dimming switch element is turned ON the next time.

DESCRIPTION OF EXEMPLARY EMBODIMENTS

A light emitting element drive device according to embodiments of the present invention will be explained below with reference to the drawings.

Figure 1:
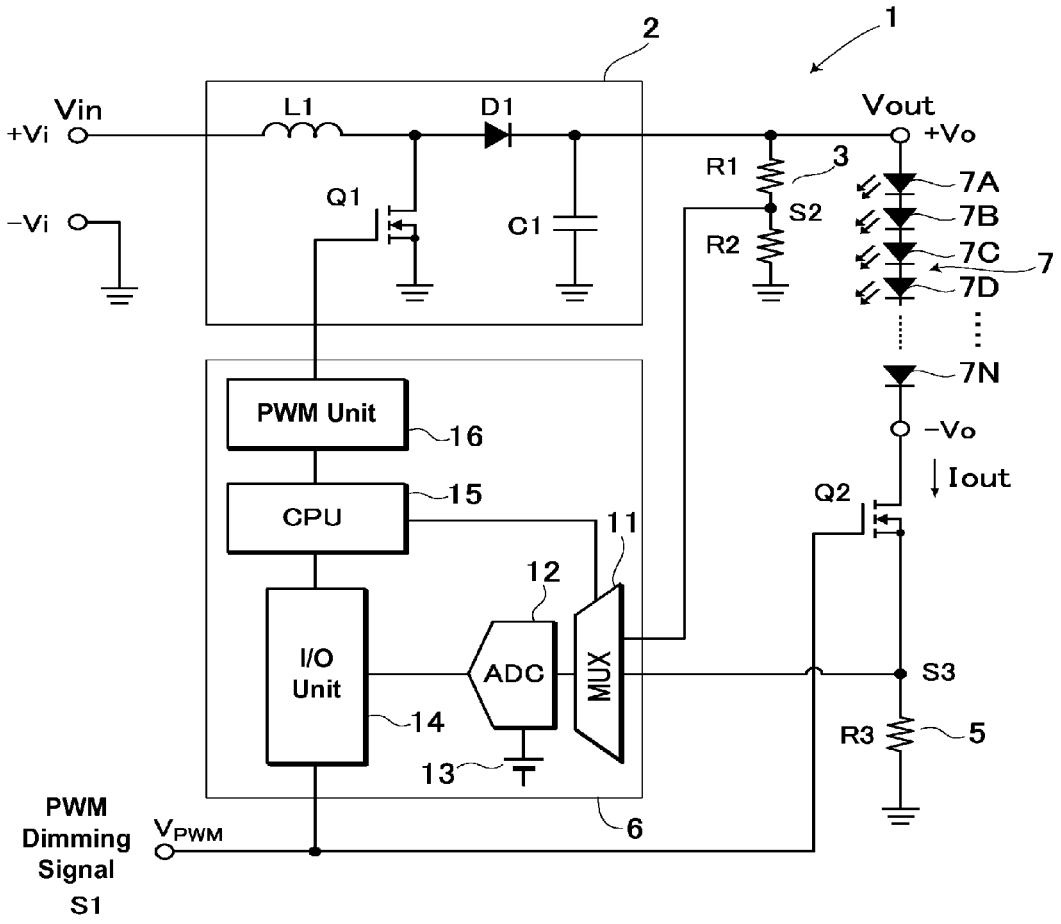
FIG. 1 is a circuit diagram of a light emitting element drive device according to a first embodiment of the present invention.

FIG. 1 shows a light emitting element drive device 1 according to a first embodiment of the present invention. The light emitting element drive device 1 is configured with a converter 2 that is an object to be controlled, a voltage detection circuit 3, a dimming switch element Q2, a current detection circuit 5 and a microprocessor 6.

The converter 2 converts a direct current input voltage Vin, which is applied between input terminals +Vi and −Vi, to a direct current output voltage Vout and supplies the direct current output voltage Vout to output terminals +Vo and −Vo. An LED module part 7, to which a plurality of LEDs 7A, 7B, 7C, 7D . . . 7N are connected in series, is connected between the output terminals +Vo and −Vo as a load. The converter 2 is configured with a step-up chopper circuit in order to convert the input voltage Vin into the output voltage Vout that is higher than the input voltage Vin. The step-up chopper circuit includes a choke coil L1, a switching element Q1, a diode D1, and a capacitor C1. Specifically, a series circuit of the choke coil L1 and the switching element Q1 is connected between the input terminals +Vi and −Vi. A series circuit of the diode D1 and the capacitor C1 is connected between both terminals of the switching element Q1. A series circuit of the LED module part 7, the dimming switch element Q2 and a resistor R3 that configures the current detection circuit 5 is connected to both terminals of the capacitor C1 in which the output voltage Vout is generated. The switching element Q1 and the dimming switch element Q2 are N channel MOSFETs (Metal Oxide Semiconductor Field Effect Transistor). However, the switching element Q1 and the dimming switch element Q2 are not limited to this structure and may be a semiconductor element with a control terminal, such as a bipolar transistor.

The voltage detection circuit 3 detects the output voltage Vout from the converter 2. The voltage detection circuit 3 is configured by connecting a series circuit of resistors R1, R2 for dividing a voltage between the terminals of the capacitor C1. An analog detection signal S2 having a voltage value that is divided the output voltage Vout is generated at a node between the resistors R1 and R2.

The current detection circuit 5 detects a current Iout flowing through the LED module part 7. The current detection circuit 5 is configured with the resistor R3 as a current detector. A series circuit of the dimming switch element Q2 and the resistor R3 is connected between the output terminal −Vo and a ground potential. A PWM dimming signal S1 from outside is provided to a gate that is a control terminal of the dimming switch element Q2. As a result, while at least the dimming switch element Q2 is turned ON, an analog detection signal S3 having a voltage value, which is in proportion to the current Iout that flows through the LED module part 7, is generated between both terminals of the resister R3. A current detector is not limited to the resistor R3. A current transformer, which has a smaller loss, may be used.

The dimming switch element Q2 has the gate that corresponds to the above control terminal, a drain as an input terminal into which the current Iout flows from the LED module part 7 and a source as an output terminal from which the current Iout flows out. The dimming switch element Q2 turns ON when the PWM dimming signal S1 is at a high (H)-level. The dimming switch element Q2 turns OFF when the PWM dimming signal S1 is at a low (L)-level. Thus, the dimming switch element Q2 performs an open/close operation for a path of the current Iout that flows through the LED module part 7.

The microprocessor 6 that corresponds to a digital control circuit calculates a control command value, which is for controlling an operation of the converter 2, by digital arithmetic. The microprocessor 6 includes a MUX 11, an ADC (analog-to-digital converter) 12, a reference power supply 13, an I/O (input output) unit 14, a CPU (central processing unit) 15 and a PWM (pulse width modulation) unit 16.

After the MUX 11 receives a selection control signal from the CPU 15 discussed later, the MUX 11 that corresponds to a multiplexer alternately outputs one of the following two voltage values: a voltage value of the detection signal S2 from the voltage detection circuit 3 and a voltage value of the detection signal S3 from the current detection circuit 5.

The ADC 12 corresponds to an analog-digital converter, in which the voltage value of the detection signal S2 or the voltage value of the detection signal S3 that are output from the MUX 11 is converted into an digital value.

The reference power supply 13 generates a reference signal as a reference voltage that is used when the ADC 12 converts an analog value into a digital value.

The I/O unit 14 corresponds to an input and output circuit that outputs a digital value from the ADC 12 and the PWM dimming signal S1 from outside to a latter part of the CPU 15.

The CPU 15 uses a voltage value of the detection signal S3 from the current detection circuit 5 as a control input value when the PWM dimming signal S1 is at the H-level, that is, when the dimming switch element Q2 is turned ON based on each output from the I/O unit 14. Further, The CPU 15 generates a control command value for determining a duty ratio of a pulse driving signal that is provided to the gate of the switching element Q1 based on the control input value. On the other hand, when the PWM dimming signal S1 is at the L-level, that is, when the dimming switch element Q2 is turned OFF, the CPU 15 uses the voltage value of the detection signal S2 from the voltage detection circuit 3 as the control input value. The CPU 15 corresponds to an arithmetic processing part that generates the control command value for determining a duty ratio of the pulse driving signal that is provided to the gate of the switching element Q1 based on the control input value. The switching of control by the CPU 15 is performed based on a signal level of the PWM dimming signal S1 that is input to the I/O port 14.

The PWM unit 16 generates a pulse driving signal of a duty ratio that is based on a control command value that is calculated in the CPU 15. Further, the PWM unit 16 provides the pulse driving signal to the gate that is a control terminal of the switching element Q1.

The PWM dimming signal S1 is respectively applied to the I/O unit 14 and the gate of the dimming switch element Q2 from a dimming input terminal VPWM of the light emitting element drive device. Because a duty ratio of the PWM dimming signal S1 is changed, the PWM dimming signal S1 can vary an effective current that flows through each of the LEDs 7A, 7B, 7C, 7D . . . 7N. A dimming control for the LED module part 7 is performed. Note that a frequency of the PWM dimming signal S1 is high enough so that a light flicker of the LED module part 7 is not noticeable. In addition, the frequency of the PWM dimming signal S1 is lower than the pulse driving signal from the PWM unit 16.

Figure 2:
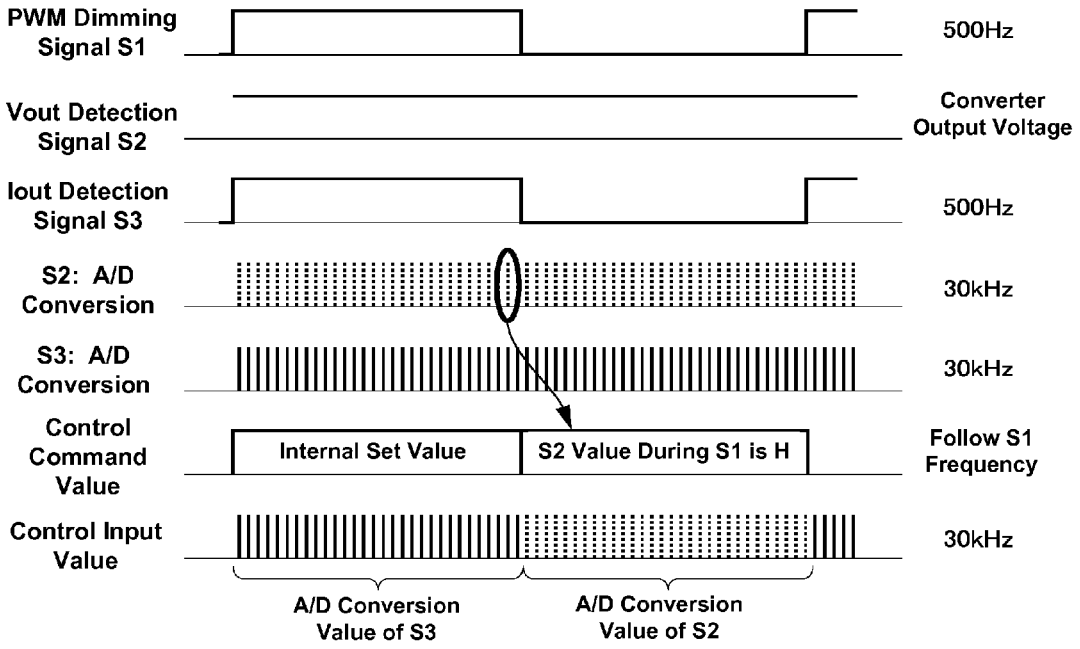
FIG. 2 is a timing diagram of each configuration of the light emitting element drive device shown in FIG. 1.

Next, functions of the above configuration are explained with reference to a timing diagram of each part shown in FIG. 2. In FIG. 2, the top most one is the PWM dimming signal S1 followed by the detection signal S2 of the output voltage Vout, the detection signal S3 of the current Tout, a A/D conversion time of the detection signal S2 in the ADC 12, a A/D conversion time of the detection signal S3 in the ADC 12, the control command value that is generated by the CPU 15, and the control input value that is used in the CPU 15.

When the pulse driving single S5 is provided to the gate of the switching element Q1 from the microprocessor 6, the switching element Q1 repeats ON and OFF operations. When the switching element Q1 is turned ON, the diode D1 is in an OFF state because the input voltage Vin is applied to the choke coil L1. Then a discharge voltage, as an output voltage Vout, of the smoothing capacitor C1 is supplied to the LED module part 7 from the converter 2. When the switching element Q1 is turned OFF, the diode D1 is in an ON state because a reverse voltage of the choke coil L1 is overlapped with the input voltage Vin. Then, the output voltage Vout that is higher than the input voltage Vin is supplied to the LED module part 7 from the converter 2 and at the same time the capacitor C1 is charged through the diode D1.

Further, according to the above embodiment, the PWM dimming signal S1 that is input from outside of the light emitting element drive device 1 can control an ON and OFF operation of the dimming switch element Q2 that is connected to the LED module part 7 in series. Therefore, by changing the duty ratio of the PWM dimming signal S1, the effective current that flow through the LED module part 7 is changed. As a result, dimming control for the LED module part 7 can be performed.

The output voltage Vout from the converter 2 is monitored by the voltage detection circuit 3. The voltage detection circuit 3 provides the detection signal S2 corresponding to a voltage value that is obtained by dividing a voltage value of the output voltage Vout by the resistors R1, R2 to the MUX 11 of the microprocessor 6.

Further, the current Iout that flows through the LED module part 7 is monitored by the current detection circuit 5. The current detection circuit 5 provides the detection signal S3 to the MUX 11 of the microprocessor 6 while the PWM dimming signal S1 is at the H-level, that is, while the dimming switch element Q2 is turned ON. The detection signal S3 is in proportion to a current value of the current Iout that is generated between both ends of the resistor R3. Therefore, when a frequency of the PWM dimming signal S1 is, for example, 500 Hz, a frequency of the detection signal S3 that is provided to the MUX 11 also becomes 500 Hz.

The MUX 11 alternately outputs one of a voltage value of the detection signal S2 from the voltage detection circuit 3 and a voltage value of the detection signal S3 from the current detection circuit 5 of a predetermined frequency that is higher than a frequency of the PWM dimming signal S1 (for example, it is 30 kHz) according to a selection control signal from the CPU 15. The ADC 12 converts an analog voltage value of the detection signal S2 or an analog voltage value of the detection signal S3 from the MUX 11 into a digital value by using a reference voltage from the reference power supply 13.

When the PWM dimming signal S1 that is input through the I/O unit 14 is at the H-level, the CPU 15 determines that the dimming switch element Q2 that is connected to the LED module part 7 in series is turned ON. On the other hand, when the PWM dimming signal S1 is at the L-level, the CPU 15 determines that the dimming switch element Q2 is turned OFF. Further, while the dimming switch element Q2 is turned ON, the CPU 15 performs feedback control so as to make the current value of the current Iout that flows through the LED module part 7 close to a predetermined first target current value. On the other hand, while the dimming switch element Q2 is turned OFF, the CPU 15 performs feedback control so as to make the voltage value of the output voltage Vout that is output from the converter 2 close to a predetermined second target voltage value.

That is, a voltage value of the detection signal S3 from the current detection circuit 5 is used as a control input value while the dimming switch element Q2 is turned ON. Thereafter, a control command value that makes the control input value close to the first target value (an internal setting value predetermined inside the CPU 15) is provided to the PWM unit 16 from the CPU 15. As a result, a pulse width of a pulse driving signal that is provided to the gate of the switching element Q1 is controlled. On the other hand, while the dimming switch element Q2 is turned OFF, the control command value that makes the voltage value of the detection signal S2 from the voltage detection circuit 3 close to the second target value is provided to the PWM 16 from the CPU 15. As a result, a pulse width of a signal that is provided to the gate of the switching element Q1 is controlled.

A voltage value of the detection signal S3 from the current detection circuit 5 corresponds to a current value of the current Iout that flows through the LED module part 7. While the dimming switch element Q2 is turned ON, the feedback control that makes the voltage value close to a voltage value, which corresponds to a predetermined target current value, is performed. On the other hand, the voltage value of the detection signal S2 from the voltage detection circuit 3 is a voltage value that is obtained by dividing the output voltage Vout from the converter 2 and that is in proportion to the output voltage Vout of the converter 2. In the present embodiment, while the dimming switch element Q2 is turned ON, the voltage value, which is obtained as a digital value by converting the detection signal S2 from the voltage detection circuit 3, is retained in the CPU 15. While the dimming switch element Q2 is turned OFF, feedback control is performed based on the voltage value of the detection signal 2 by configuring the retained voltage value of the detection signal S2 as the second target value.

Further, the ADC 12 repeats an A/D conversion process at a predetermined cycle and outputs a new digital voltage value every time the A/D conversion process is finished. When a new digital voltage value is output from the ADC 12 while the dimming switch element Q2 is turned ON, the CPU 15 retains the new digital voltage value instead of a previously retained digital voltage value (For example, the CPU 15 retains it in a resistor or a memory circuit in the CPU 15). On the other hand, when the new digital voltage value is output from the ADC 12 while the dimming switch element Q2 is turned OFF, the CPU 15 keep retaining a currently retained digital voltage value. Therefore, the CPU 15 retains a digital voltage value, which is obtained immediately before the dimming switch element Q2 is switched from an ON state to an OFF state, until the dimming switching element Q2 is turned ON the next time.

The output voltage Vout of the converter 2 while the dimming switch element Q2 is turned OFF is maintained at the same voltage value as the output voltage Vout of the converter 2 while the dimming switch element Q2 is turned ON. Therefore, immediately after the dimming switch element Q2 is turned ON the next time, a voltage value of the detection signal S3 from the current detection circuit 5 can reach the predetermined first target value.

The second target value is updated at every cycle of turning ON and OFF of the dimming switch element Q2. That is, while the dimming switch element Q2 is turned OFF, the second target value for the voltage value of the detection signal S2 from the voltage detection circuit 3 is configured based on the voltage value of the detection signal S2 that is detected immediately before the current state, i.e., at the time in which the dimming switch element Q2 is previously turned ON. While the dimming switch element Q2 is turned ON, it is preferred that a time for detecting the voltage value of the detection signal S2 in order to configure the second target value is after a voltage value of the detection signal S3 from the current detection circuit 5 reaches the first target value. That is, it is preferred for detecting the voltage value of the detection signal S2 when a voltage value of the detection signal S3 nearly corresponds to (is substantially the same as) the first target value. Therefore, it is the most preferred that the time for detecting the voltage value of the detection signal S2 is immediately before the dimming switch element Q2 is turned OFF. This is because, in most cases, at this time, the above condition in which a voltage value of the detection signal S3 from the current detection circuit 5 nearly corresponds to (is substantially the same as) the first target value is satisfied.

As explained above, in the present embodiment, the light emitting element drive device 1 is configured with the converter 2 as a power conversion circuit and the dimming switch element Q2. The converter 2 provides electric power to each of LEDs 7A, 7B, 7C, 7D . . . 7N of the LED module part 7 that are light emitting elements. The dimming switch element Q2 opens and closes a path of the current Iout that flows through the LED module part 7. Further, the light emitting element drive device 1 is provided with the current detection circuit 5, the voltage detection circuit 3 and the microprocessor 6. The current detection circuit 5 detects a current value of the current Iout that flows through the light emitting elements. The voltage detection circuit 3 detects a voltage value of the output voltage Vout that is output from the converter 2. The microprocessor 6 is a control circuit that performs feedback control so that a current value of the current Iout detected by the current detection circuit 5 approaches the first target value while the dimming switch element Q2 is turned ON. The control circuit also performs feedback control so that a voltage value of the output voltage Vout detected by the voltage detection circuit 3 approaches the second target value while the dimming switch element Q2 is turned OFF. The first target value is a predetermined value that is determined inside the microprocessor 6 in advance. The second target value is set based on a voltage value of the output voltage Vout that is detected by the voltage detection circuit 3 while the dimming switch element Q2 is turned ON in the microprocessor 6.

As a result, while the dimming switch element Q2 is turned ON, a constant current control of the LED module part 7 is performed in such a way in which a current value of the current Iout that flows through the LED module part 7 approaches the predetermined first target value. On the other hand, while the dimming switch element Q2 is turned OFF, control of the LED module part 7 is performed in such a way in which a voltage value of the output voltage Vout that is output from the converter 2 approaches the second target value. The second target value is set based on the voltage value of the output voltage Vout detected by the voltage detection circuit 3 while the dimming switch element Q2 is turned ON. Therefore, the output voltage Vout of the converter 2 while the dimming switch element Q2 is turned OFF depends on the output voltage Vout of the converter 2 while the dimming switch element Q2 is turned ON. As a result, it can be realized that while the dimming switch element Q2 is turned ON, the current value of the current Iout detected by the current detection circuit 5 can reach the predetermined first target value as soon as possible. Thus, it can also be realized that a period of time for which the current Iout that flows through the LED module part 7 reaches the first target value as a target current value shortens in light emitting element drive device 1 that uses the PWM dimming.

Desirably, when the current value of the current Iout detected by the current detection circuit 5 nearly corresponds to (is substantially the same as) the first target value while the dimming switch element Q2 is turned ON, the second target value is set based on the voltage value of the output voltage Vout detected by the voltage detection circuit 3 in the microprocessor 6.

In this case, while the dimming switch element Q2 is turned ON, specifically under a condition in which the current value of the current Iout detected by the current detection circuit 5 nearly corresponds to (is substantially the same as) the first target value, the second target value is set based on the voltage value of the output voltage Vout detected by the voltage detection circuit 3. Therefore, the output voltage Vout of the converter 2 while the dimming switch element Q2 is turned OFF is maintained at the same voltage value as the output voltage Vout of the converter 2 while the dimming switch element Q2 is turned ON. Therefore, when the dimming switch element Q2 is turned ON, the current value of the current Iout detected by the current detection circuit 5 can immediately reach the predetermined first target value. As a result, a period of time required to reach the first target value for the current Iout flowing in the LED module part 7 can certainly be shortened.

Instead of performing the above features, the microprocessor 6 may be configured such that the second target value is set based on the voltage value detected by the voltage detection circuit 3 immediately before the dimming switch element Q2 is turned OFF.

Immediately before the dimming switch element Q2 is turned OFF, in almost all cases, a current value of the current Iout detected in the current detection circuit 5 nearly corresponds to (is substantially the same as) the first target voltage. Therefore, in the case in which the second target value is set based on a voltage value detected by the voltage detection circuit 3 immediately before the dimming switch element Q2 is turned OFF, even though it is not determined whether the current value of the current Iout detected by the current detection circuit 5 nearly corresponds to (is substantially the same as) the first target value while the dimming switch element Q2 is turned ON, the following can be realized. An output voltage Vout of the converter 2 while the dimming switch element Q2 is turned OFF can be maintained at the same voltage as an output voltage Vout of the converter 2 while the dimming switch element Q2 is turned ON. Thus, a period of time required to reach the first target value for the current Iout flowing in the LED module part 7 can certainly be shortened.

Further, the microprocessor 6 according to the present embodiment includes the ADC 12 and the CPU 15. The ADC 12 is a conversion circuit that converts a voltage value of the output value Vout detected by the voltage detection circuit 3 into a digital value. The CPU 15 is a retaining circuit that retains the digital value that is output from the ADC 12. The ADC 12 repeats a conversion process at a predetermined cycle. When a new digital value is output from the ADC 12 while the dimming switch element Q2 is turned ON, the CPU 15 replaces the retained previous digital value with such the new digital value. When the new digital value is output from the ADC 12 while the dimming switch element Q2 is turned OFF, the CPU 15 operates to keep retaining the retained previous digital value. The microprocessor 6 uses the digital value that is retained in the CPU 15 as the second target value.

As a result, immediately after the dimming switch element Q2 is turned ON the next time, a voltage value of the detection signal S3 from the current detection circuit 5 can reach the predetermined first target value.

Next, a light emitting element drive device 1 according to a second embodiment of the present invention is explained with reference to FIG. 3. In the present embodiment, the light emitting element drive device 1 includes another voltage detection circuit that detects a voltage value of a drain that is an input terminal of the dimming switch element Q2 and a voltage detection line 21. One end of the voltage detection line 21 is connected to the drain of the dimming switch element Q2. Another end of the voltage detection line 21 is connected to an input terminal of the MUX 11. Further, the light emitting element drive device 1 has an operational amplifier 22, a switching unit 23 and a reference power supply 24. Specifically, the operational amplifier 22 drives the dimming switch element Q2. The switching unit 23 is switched according to a signal level of the PWM dimming signal S1 and is equivalently shown as a switch in FIG. 3. The reference power supply 24 determines an If command value that is a target value for the current Iout that flows through the LED module part 7. The analog detection signal S3 from the current detection circuit 5 is applied to an inverting input terminal that is another input terminal of the operational amplifier 22, not to the MUX 11. The other components are in common with the components of the light emitting element drive device 1 according to the first embodiment shown in FIG. 1.

Figure 3:
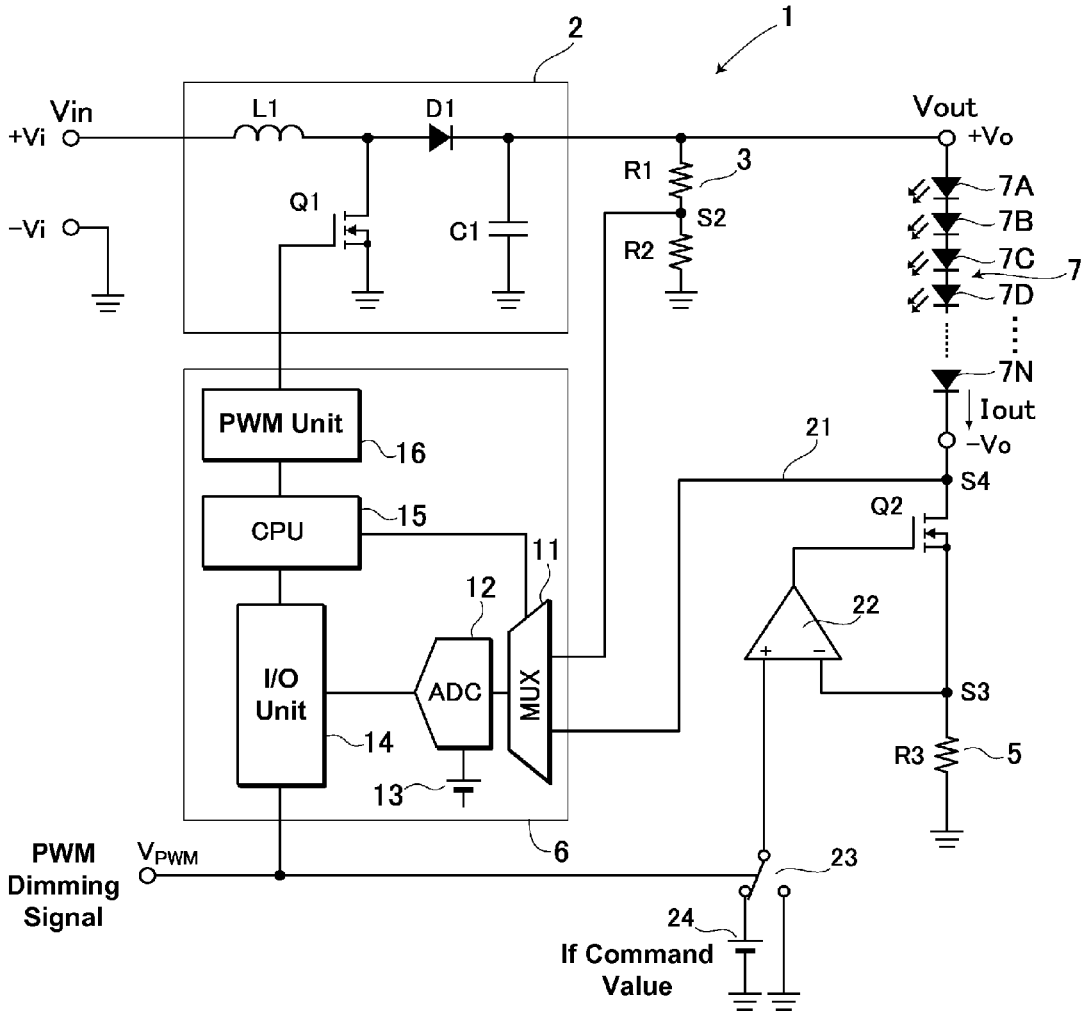
FIG. 3 is a circuit diagram of a light emitting element drive device according to a second embodiment of the present invention.

In the circuit shown in FIG. 3, when a signal level of the PWM dimming signal S1 is at the H-level, the If command value that is generated by the reference power supply 24 is input to a non-inverting input terminal, which is the other input terminal of the operational amplifier 22, as a voltage value that indicates a target value of the current Iout flowing through the LED module part 7. In contrast, the signal level of the PWM dimming signal S1 is at the L-level, a ground voltage (0V) is input to the non-inverting input terminal of the operational amplifier 22. Therefore, when a signal level of the PWM dimming signal S1 is at the H-level, the operational amplifier 22 controls the operation of the dimming switch element Q2 so that a current value of the current Iout flowing in each of LEDs 7A, 7B, 7C, 7D . . . 7N of the LED module part 7 approaches the If command value that is a third target value. On the other hand, when a signal level of the PWM dimming signal S1 is at the L-level, the operational amplifier 22 makes the dimming switch element Q2 be in an OFF state by making a signal level of the gate of the dimming switch element Q2 be at the L-level.

According to the second embodiment, an ON and OF operation of the dimming switch element Q2 can be controlled through the switching unit 23 and the operational amplifier 22 by the PWM dimming signal S1 provided from outside of the light emitting element drive device 1. Thus, an effective current flowing in the LED module part 7 is changed by varying a duty ratio of the PWM dimming signal S1. As a result, a dimming of the LED module part 7 can be performed.

The MUX 11 that configures the microprocessor 6 alternately outputs one of the detection signal S2 from the voltage detection circuit 3 and a detection signal S4 from the voltage detection line 21 that shows a voltage value of the drain of the dimming switch element Q2 by receiving a selection control signal from the CPU 15. Regarding a signal level of the detection signal S4, a voltage value of the detection signal S4 becomes higher when the PWM dimming signal S1 is at the L-level as compared to when the PWM dimming signal S1 is at the H-level. This is because the current Iout that flows through the LED module part 7 becomes weak and a voltage drop of the LEDs 7A, 7B, 7C, 7D . . . 7N becomes small when the PWM dimming signal S1 is at the L-level. That is, in the circuit shown in FIG. 3, the voltage value of the detection signal S4 is a value that is obtained by subtracting a voltage drop Vf of LEDs 7A, 7B, 7C, 7D . . . 7N from an output voltage Vout (i.e., Vout-Vf). When the PWM dimming signal S1 is at the L-level, the voltage value of the detection signal S4 increases because the voltage drop Vf becomes smaller compared with a state in which the PWM dimming signal S1 is at the H-level (the voltage drop Vf becomes larger). Then, an analog voltage value of the detection signal S2 or an analog voltage value of the detection signal S4 from the MUX 11 is converted to a digital voltage value. The converted digital voltage value is provided from the I/O unit 14 to the CPU 15 along with the PWM dimming signal S1 from outside.

While the dimming switch element Q2 is turned ON, that is, when a current flows through the LED module part 7, the CPU 15 performs feedback control so that a voltage value of the drain of the dimming switch element Q2 appears to approach the predetermined first target value. On the other hand, while the dimming switch element Q2 is turned OFF, that is, when the current does not flow through the LED module part 7, the CPU 15 performs feedback control so that the voltage value of the output voltage Vout appears to approach the second target value.

Specifically, while the dimming switch element Q2 is turned ON, a voltage value of the detection signal S4 from the voltage detection line 21 is used as a control input value. Thereafter, a control command value that makes the control input value close to the first target value (an internal setting value predetermined inside the CPU 15) is provided to the PWM unit 16 from the CPU 15. As a result, a pulse width of a pulse driving signal that is provided to the gate of the switching element Q1 is controlled. On the other hand, while the dimming switch element Q2 is turned OFF, the control command value that makes the voltage value of the detection signal S2 from the voltage detection circuit 3 close to the second target value is provided to the PWM 16 from the CPU 15. As a result, a pulse width of a signal that is provided to the gate of the switching element Q1 is controlled. In the present embodiment, while the dimming switch element Q2 is turned ON, the voltage value of the detection signal S2 from the voltage detection circuit 3 is retained inside the CPU 15. While the dimming switch element Q2 is turned OFF, the feedback control, in which the retained voltage value of the detection signal S2 is set as the second target value, based on the voltage value of the detection signal S2 is performed.

The output voltage Vout of the converter 2 while the dimming switch element Q2 is turned OFF is maintained at the same voltage value as the output voltage Vout of the converter 2 while the dimming switch element Q2 is turned ON. Therefore, immediately after the dimming switch element Q2 is turned ON the next time, a voltage value of the drain of the dimming switch element Q2 can reach the predetermined first target value.

In the second embodiment, while the dimming switch element Q2 is turned ON, it is preferred that a time for detecting the voltage value of the detection signal S2 in order to configure the second target value is after a voltage value of the drain of the dimming switch element Q2 reaches the first target value. That is, it is preferred for detecting the voltage value of the detection signal S2 when a voltage value of the detection signal S4 nearly corresponds to (is substantially the same as) the first target value. Therefore, when a time for detecting the voltage value of the detection signal S2 is configured immediately before the dimming switch element Q2 is turned OFF, the voltage value of the detection signal S4 from the voltage detection line 21 can nearly correspond to (is substantially the same as) the first voltage value.

As discussed above, the light emitting element drive device 1 according to the second embodiment includes the voltage detection line 21, the voltage detection circuit 3 and the microprocessor 6. Specifically, the voltage detection line 21 is a first voltage detection circuit that detects a voltage value of the drain that is an input terminal of the dimming switch element Q2. The voltage detection circuit 3 detects a voltage value of the output voltage Vout that is output from the converter 2. The microprocessor 6 performs feedback control so that a voltage value of the drain of the dimming switch element Q2, which is detected by the voltage detection line 21, appears to approach the first target value while the dimming switch element Q2 is turned ON. The microprocessor 6 also performs feedback control so that a voltage value of the output voltage Vout, which is detected by the voltage detection circuit 3, appears to approach the second target value while the dimming switch element Q2 is turned OFF. The first target value is a predetermined value. The microprocessor 6 is configured such that the second target value is set based on a voltage value of the output voltage Vout that is detected by the voltage detection circuit 3 while the dimming switch element Q2 is turned ON.

That is, while the dimming switch element Q2 is turned ON, the LED module part 7 is controlled in such a way in which a voltage value of the drain of the dimming switch element Q2 appears to approach the predetermined first target value. On the other hand, while the dimming switch element Q2 is turned OFF, the LED module part 7 is controlled in such a way in which a voltage value of the output voltage Vout that is output from the converter 2 appears to approach the second target value. The second target voltage is set based on the voltage value of the output voltage Vout that is detected by the voltage detection circuit 3 while the dimming switch element Q2 is turned ON. Therefore, the output voltage Vout of the converter 2 while the dimming switch element Q2 is turned OFF depends on the output voltage Vout of the converter 2 while the dimming switch element Q2 is turned ON. As a result, it can be realized that while the dimming switch element Q2 is turned ON, the voltage value of the drain of the dimming switch element Q2 can reach the predetermined first target value as soon as possible. Thus, in the light emitting element drive device 1 in which the PWM dimming is used, it can also be realized that a period of time for which the current Iout that flows through the LED module part 7 reaches a target current value can be shortened.

It is also preferred that the light emitting element drive device 1 additionally includes the resistor R3, the operational amplifier 22 and the reference power supply 24. The resistor R3 is a resistor element that is connected to the source that is an output terminal of the dimming switch element Q2. The operational amplifier 22 as an adjustment circuit adjusts a voltage that is applied to a control terminal of the dimming switch element Q2 so as to make the voltage value, which is detected by the resistor R3, of the source of the dimming switch element Q2 close to the If command value as the third target value.

As a result, by only adding the operational amplifier 22 as the adjustment circuit and the reference power supply 24 and by being independent from the feedback control by the microprocessor 6, a voltage value of the source of the dimming switch element Q2, that corresponds to a current value of the current Iout flowing through the LED module part 7, can approach the If command value of the reference power supply 24 that is set as the third target value.

Further, the microprocessor 6 according to the present embodiment includes the ADC 12 and the CPU 15. Specifically, the ADC 12 is a conversion circuit that converts a voltage value of the output voltage Vout that is detected by the voltage detection circuit 3 into a digital value. The CPU 15 is a retaining circuit that retains the digital value that is output from the ADC 12. The ADC repeats a conversion process at a predetermined cycle. When a new digital value is output from the ADC 12 while the dimming switch element Q2 is turned ON, the CPU 15 replaces the retained pervious digital value with such the new digital value. When the new digital value is output from the ADC 12 while the dimming switch element Q2 is turned OFF, the CPU 15 operates to keep retaining the retained previous digital value. The microprocessor 6 uses the digital value that is retained in the CPU 15 as the second target value.

As a result, immediately after the dimming switch element Q2 is turned ON the next time, a voltage value of the detection signal S3 of the drain of the dimming switch element Q2 can reach the predetermined first target value.

Embodiments according to the present invention have been explained. However, the present invention should not be limited to the embodiments because those embodiments are examples for explaining the present invention. Undoubtedly, several modifications may be made without departing from the spirit and scope of the invention. For example, the converter 2 is not limited to the step-up chopper circuit as shown in the drawings. The converter 2 can be a converter with any circuit configuration with one or more switching elements. In addition, signal levels and logic states of each of the disclosed elements may be different from those actually discussed in the embodiments so as to achieve the same effects. Further, a single LED as a light emitting element may be used instead of the LED module part 7 including the plurality of LEDs 7A, 7B, 7C, 7D, . . . 7N.

The light emitting element drive device being thus described, it will be apparent that the same may be varied in many ways. Such variations are not to be regarded as a departure from the spirit and scope of the invention, and all such modifications as would be apparent to one of ordinary skill in the art are intended to be included within the scope of the following claims.

What is claimed is:

1. A light emitting element drive device, comprising:

a light emitting element;

a power conversion circuit that supplies electric power to the light emitting element;

a dimming switch element that performs an open/close operation for a path in which a current flows in the light emitting element;

a current detection circuit that detects a current value of the current flowing in the light emitting element;

a voltage detection circuit that detects a voltage value of a voltage that is output from the power conversion circuit; and a control circuit that performs feedback control, wherein when the dimming switch element is turned ON, the control circuit performs feedback control so as to make the current value close to a first target value, and the first target value is a predetermined value, when the dimming switch element is turned OFF, the control circuit performs the feedback control so as to make the voltage value close to a second target value, and the second target value is set based on the voltage value, and the second target value is set based on the voltage value that is detected by the voltage detection circuit while the dimming switch element is turned ON.

2. The light emitting element drive device according to claim 1, wherein the control circuit further comprises:

a conversion circuit that performs a conversion operation in which the voltage value is converted to a digital value; and a retaining circuit that retains the digital value output from the conversion circuit as a retained digital value, wherein the conversion circuit repeats the conversion operation in a predetermined cycle so that a new digital value is output after a previous digital value is output, when the conversion circuit outputs the new digital value while the dimming switch element is turned ON, the retaining circuit exchanges the previous digital value with the new digital value, when the conversion circuit outputs the new digital value while the dimming switch element is turned OFF, the retaining circuit retains the previous digital value, and the control circuit determines that the retained digital value is the second target value.

3. The light emitting element drive device according to claim 1, wherein the second target value is set based on the voltage value that is detected by the voltage detection circuit when the current value is substantially the same as the first target value.

4. The light emitting element drive device according to claim 3, wherein the control circuit further comprises:

a conversion circuit that performs a conversion operation in which the voltage value is converted to a digital value; and a retaining circuit that retains the digital value output from the conversion circuit as a retained digital value, wherein the conversion circuit repeats the conversion operation in a predetermined cycle so that a new digital value is output after a previous digital value is output, when the conversion circuit outputs the new digital value while the dimming switch element is turned ON, the retaining circuit exchanges the previous digital value with the new digital value, when the conversion circuit outputs the new digital value while the dimming switch element is turned OFF, the retaining circuit retains the previous digital value, and the control circuit determines that the retained digital value is the second target value.

5. The light emitting element drive device according to claim 1, wherein the second target value is set based on the voltage value that is detected by the voltage detection circuit immediately before the light emitting element is turned OFF.

6. The light emitting element drive device according to claim 5, wherein the control circuit further comprises:

a conversion circuit that performs a conversion operation in which the voltage value is converted to a digital value; and a retaining circuit that retains the digital value output from the conversion circuit as a retained digital value, wherein the conversion circuit repeats the conversion operation in a predetermined cycle so that a new digital value is output after a previous digital value is output, when the conversion circuit outputs the new digital value while the dimming switch element is turned ON, the retaining circuit exchanges the previous digital value with the new digital value, when the conversion circuit outputs the new digital value while the dimming switch element is turned OFF, the retaining circuit retains the previous digital value, and the control circuit determines that the retained digital value is the second target value.

7. A light emitting element drive device, comprising:

a light emitting element;

a power conversion circuit that supplies electric power to the light emitting element;

a dimming switch element that performs an open/close operation for a path in which a current flows in the light emitting element;

a first voltage detection circuit that detects a first voltage value of a first voltage of an input terminal of the dimming switch element;

a second voltage detection circuit that detects a second voltage value of a second voltage that is output from the power conversion circuit; and a control circuit that performs feedback control, wherein when the dimming switch element is turned ON, the control circuit performs the feedback control so as to make the first voltage value close to a first target value, and the first target value is a predetermined value, when the dimming switch element is turned OFF, the control circuit performs the feedback control so as to make the second voltage value close to a second target value, and the second target value is set based on the second voltage value, and the second target value is set based on the voltage value that is detected by the voltage detection circuit while the dimming switch element is turned ON.

8. The light emitting element drive device according to claim 7, wherein the control circuit further comprises:

a conversion circuit that performs a conversion operation in which the voltage value is converted to a digital value; and a retaining circuit that retains the digital value output from the conversion circuit as a retained digital value, wherein the conversion circuit repeats the conversion operation in a predetermined cycle so that a new digital value is output after a previous digital value is output, when the conversion circuit outputs the new digital value while the dimming switch element is turned ON, the retaining circuit exchanges the previous digital value with the new digital value, when the conversion circuit outputs the new digital value while the dimming switch element is turned OFF, the retaining circuit retains the previous digital value, and the control circuit determines that the retained digital value is the second target value.

9. The light emitting element drive device according to claim 7, further comprising a resistor that is connected to an output terminal of the dimming switch element, and an adjustment circuit that adjusts a third voltage applied to a control terminal of the dimming switch element so as to make a third voltage value of the third voltage close to a third target value.

10. The light emitting element drive device according to claim 9, wherein the control circuit further comprises:

a conversion circuit that performs a conversion operation in which the voltage value is converted to a digital value; and a retaining circuit that retains the digital value output from the conversion circuit as a retained digital value, wherein the conversion circuit repeats the conversion operation in a predetermined cycle so that a new digital value is output after a previous digital value is output, when the conversion circuit outputs the new digital value while the dimming switch element is turned ON, the retaining circuit exchanges the previous digital value with the new digital value, when the conversion circuit outputs the new digital value while the dimming switch element is turned OFF, the retaining circuit retains the previous digital value, and the control circuit determines that the retained digital value is the second target value.

* * * * *